United States Patent [19]

Tingley

[11] Patent Number: 4,940,242

[45] Date of Patent: Jul. 10, 1990

[54] GAME APPARATUS

[76] Inventor: Todd J. Tingley, 425 Avenue G., Redondo Beach, Calif. 90277

[21] Appl. No.: 354,736

[22] Filed: May 22, 1989

[51] Int. Cl.[5] ..... A63F 3/02; A63F 3/00

[52] U.S. Cl. ..... 273/287; 273/248; 273/260; 273/285; 273/31

[58] Field of Search ..... 273/285–287, 273/31, 1 A, 408, 411, 85, 260, 55 R; 434/251; 272/111–113

[56] References Cited

U.S. PATENT DOCUMENTS

| | | | |
|---|---|---|---|
| 638,220 | 12/1899 | De Wolf | 273/411 |
| 2,017,536 | 10/1935 | Hase et al. | 273/1 A |
| 3,131,934 | 5/1964 | Green | 273/260 |
| 3,345,068 | 10/1967 | Bowen | 273/1 A |
| 3,948,521 | 4/1976 | Warren | 273/411 |

FOREIGN PATENT DOCUMENTS

| | | | |
|---|---|---|---|
| 16891 | of 1902 | United Kingdom | 273/408 |
| 599727 | 3/1948 | United Kingdom | 273/411 |

*Primary Examiner*—Benjamin Layno
*Attorney, Agent, or Firm*—Francis X. LoJacono

[57] ABSTRACT

The present invention is specifically designed as an outdoor game apparatus for use in such areas as sandy beaches and grassy parks wherein the game is laid out on the ground surface and secured in place by peg members. The game consists of a group of cord members that are connected and woven together. When laid on the ground the cord members outline a game play surface, sometimes referred to as a game board where the ground surface itself is the board surface for the placement of game pieces. This game board is flexible and adapted to be secured in a fixed layout for playing a game such as backgammon, checkers or chess. A peripheral cord defines a quadrilateral playing area having a plurality of play sections to receive game pieces. Hold-down rings are attached to the peripheral cord and are adapted to receive pegs therein wherby the game is held on the ground for game play.

7 Claims, 3 Drawing Sheets

12
14
16
18
20
22
24
26
28
30
34
36
38
40
42
44
45
46
48

GAME APPARATUS

BACKGROUND OF THE INVENTION

1. Field of the Invention

The present invention relates generally to a game apparatus and more particularly to a game apparatus that is designed for playing outdoors such as at beaches and parks wherein the apparatus is laid out on the ground surface and secured in place by peg members.

2. Description of the Prior Art

There are many game devices of the character herein disclosed but these are commonly formed and laid out on wood or paper base member. However, these known types of game devices are limited in their use, and they have features that restrict their use to particular situations or circumstances, for example, game boards such as backgammon, chess, checkers, etc. wherein they do not suitably lend themselves to game play when they are placed on rough ground surfaces such as found in grassy parks and more particularly sandy beach areas. Thus, if there are various game pieces or objects used in playing a particular game which are positioned on a board, then it becomes a problem in arranging the game pieces on the board when it is not placed on level ground. Expensive boards are themselves not conducive for play in environments found at sandy beaches or other recreational areas. Under such conditions expensive games can be damaged.

SUMMARY AND OBJECTS OF THE INVENTION

The present invention is specifically designed and arranged for outdoor use in such areas as grassy parks and sandy beaches, and other outdoor areas where it becomes a problem of playing on the ground that is not level and where benches or tables are not available. The well known board games are generally not designed for use under such conditions. Accordingly, the present invention consists of a plurality of strings or cord members that are connected and woven together so as to establish a game that is flexible and adapted to be secured in a fixed playing position on ground surfaces and more particularly on sandy beaches and other uneven ground areas. A peripheral line or cord forming a quadrilateral configuration is provided and has a plurality of hold-down ring members secured to at least four of the corners thereof which are arranged to receive securing pegs whereby the game is positioned for play. Additional cord members are interwoven to define play sections wherein game pieces are positioned therein for play. Thus, the arrangement and configuration of these cords not only define play sections, but further define the type of game that can be played. The configuration of each sections can be arranged to provide a playing surface for backgammon or checkers and chess.

Accordingly, the present invention has for an important object to provide a game device that allows such basic games as chess, checkers and others, and more particularly backgammon, to be readily used under various outdoor conditions.

Still another object of the invention is to provide a game apparatus of this type that is playable on outdoor ground surfaces such as found at the beaches, parks, and other recreational places.

It is still another object of the invention to provide a game device wherein the play area thereof consists of a plurality of cord members that are woven or interconnected together to define play sections in which game pieces are placed therein for play.

Another object of this invention is to provide a game apparatus of this character that includes means to secure or hold the game device in a fixed stretched layout, wherein such means consists of a plurality of securing ring members attached to the peripheral cord member that defines the shape of the playing area and includes peg members that are positioned within the ring members and driven into the ground. Thus, the peg members secure the play area in its proper configuration. The play area will hereinafter be referred to as the board game.

Yet another object of the present invention is to provide board game wherein various shapes and configurations thereof can be formed for specific games particularly those games that require a quadrilateral arrangement such as chess, checkers and backgammon games. However, circular as well as triangular configurations are also possible.

Still another object of the present invention is to provide a board game of the type described wherein the ring members are selectively positioned at each of the four corners of the board game.

A still further object of the invention is to provide a board game having play sections that are formed in a triangular configuration as well as square configurations.

A further object of the invention is to provide a game apparatus of the character that includes relatively few moving parts and is easy to mount and secure.

Still a further object of the invention is to provide a game apparatus of this type that is easy to keep clean and maintain.

And yet another object of the present invention is to provide a game device of the character that is relatively inexpensive to manufacture, and is simple and rugged in construction for use outdoors for which it is specifically designed.

The characteristics and advantages of the invention are further sufficiently referred to in connection with the accompanying drawings, which represent two embodiments thereof. After considering these examples, skilled persons will understand that variations may be made without departing from the principles disclosed; and I contemplate the employment of any structure, arrangements or modes or operation that are properly within the scope of the appended claims.

BRIEF DESCRIPTION OF THE DRAWINGS

Novel features and advantages of the present invention in addition to those mentioned above will become apparent to those skilled in the art from reading the following detailed description in conjunction with the accompanying drawings wherein.

DESCRIPTION OF THE PREFERRED EMBODIMENTS

Figures 1, 4, 5:
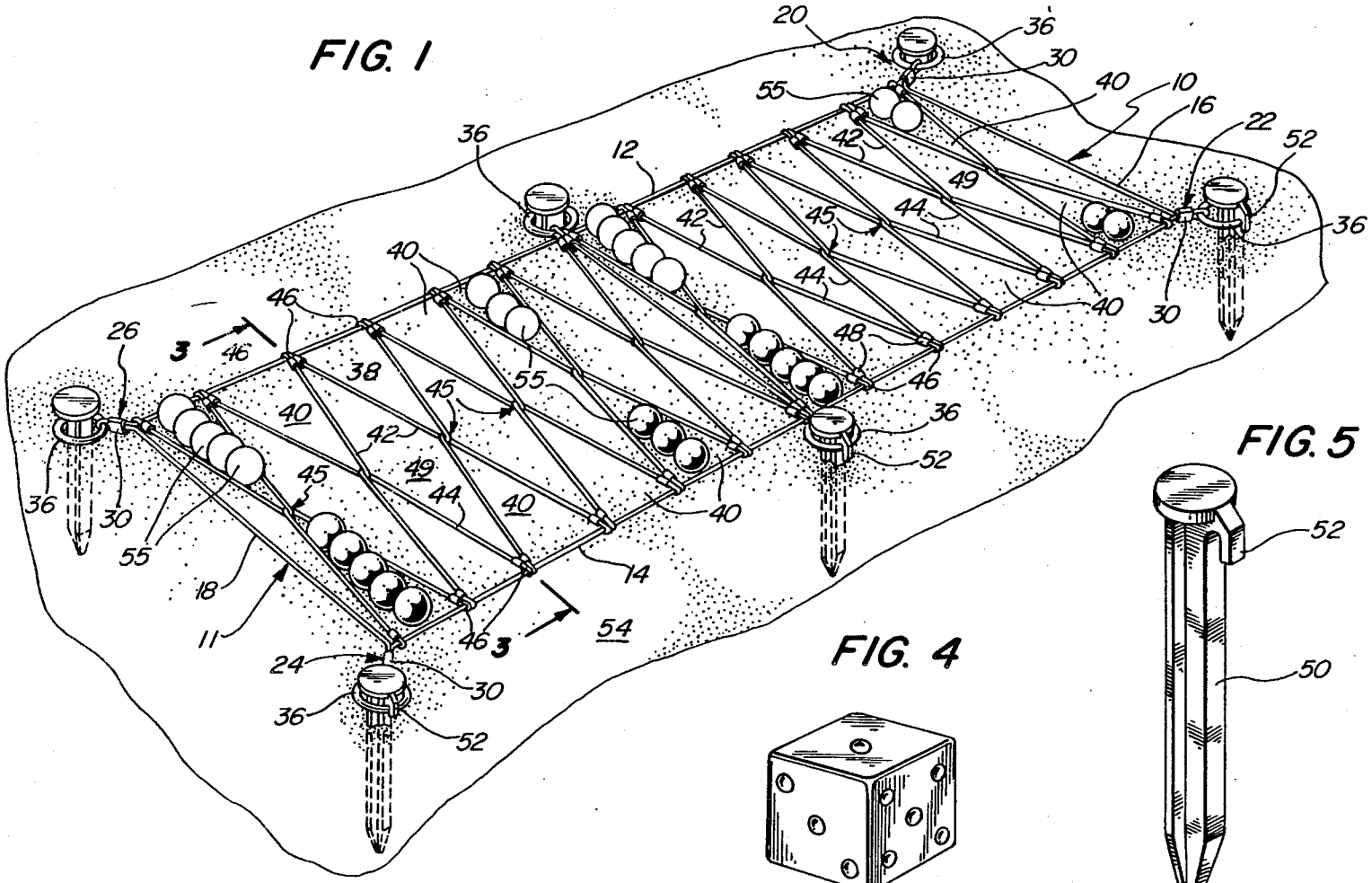
FIG. 1 is a pictorial view of the present invention in use and illustrated in a playing mode with several game pieces arranged in various play sections.
FIG. 4 is a perspective view of one of the dice used for playing the game illustrated in FIG. 1.
FIG. 5 is a perspective view of a peg device used to aide in securing the board game in a proper playing mode.
Figures 2, 3:
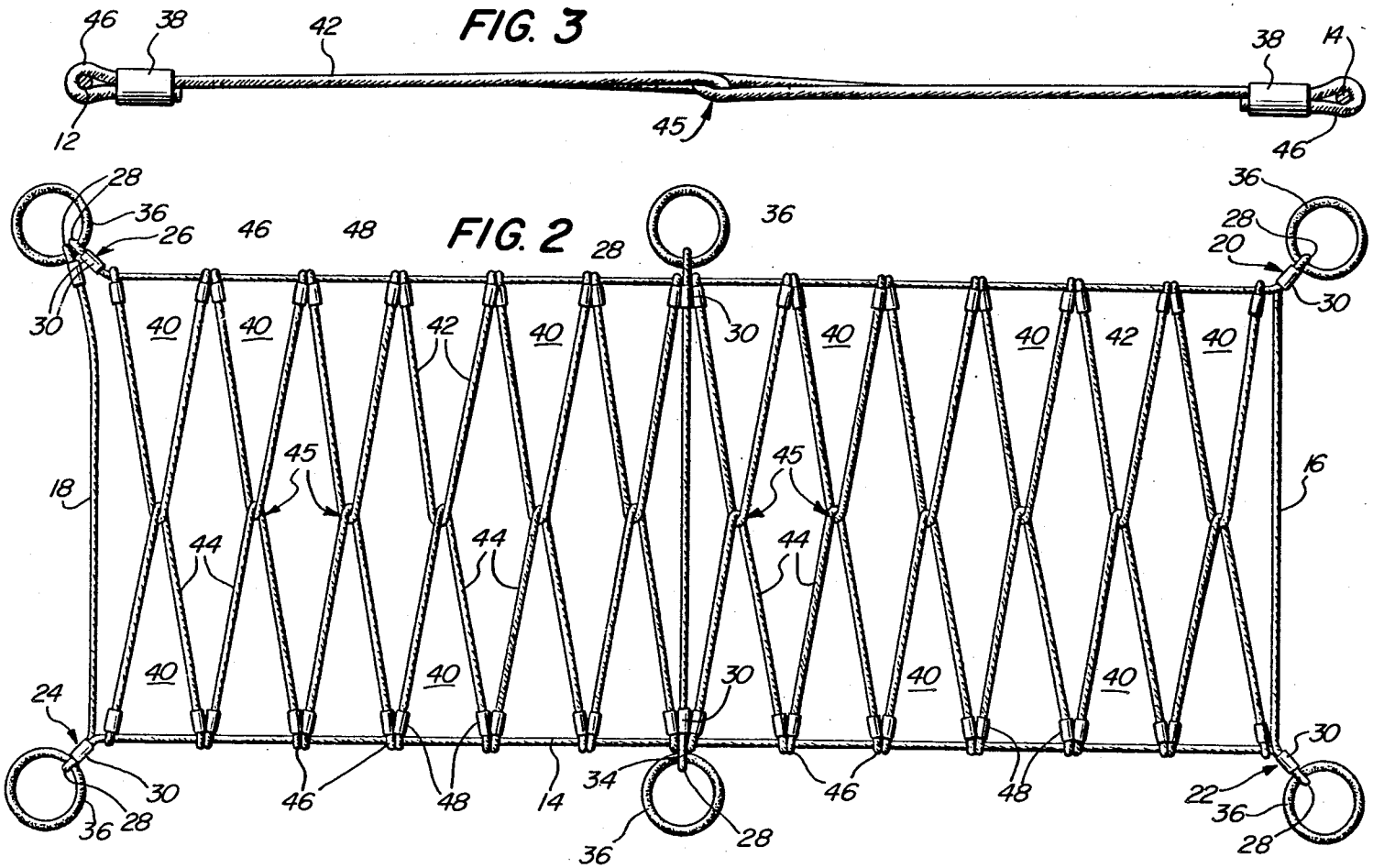
FIG. 2 is an enlarged top plan view of the game apparatus showing one of the preferred embodiments thereof.
FIG. 3 is an enlarged cross-sectional view taken transversely along line 3—3 of FIG. 1.

Referring more particularly to the embodiment as illustrated in FIG. 1, there is shown a pictorial view of a game apparatus, generally indicated at 10, which has a basic quadrilateral configuration forming a generally rectangular playing area defined by an elongated cord 11. The cord 11 provides a pair of elongated parallel cord members 12 and 14, respectively, together with a pair of parallel shorter end cord members 16 and 18, whereby four corners are generally defined at 20, 22, 24 and 26, with each corner formed having an eyelet 28. Each eyelet 28 is formed by a loop held in place by a clip member 30. A central transverse cord member 32 is connected to the central portion of each elongated side cord member 12 and 14 (as seen in FIGS. 1 and 2) by eyelets 34. Side cords 12 and 14 pass through these eyelets which further provide a loop to receive and attach to a part of the securing means. That is, the basic rectangular configuration is secured by means of a plurality of enlarged hold-down ring members 36.

Hence, the peripheral outline of the game apparatus establishes a playing area that is defined by the sides 12, and 14, and end cord members 16 and 18, thereof. Within the playing area there is formed a plurality of play sections, generally designated at 40, with play sections 40 being contiguously arranged by means of a plurality of pairs of cord members 42 and 44, as seen in FIGS. 1 and 2. Each pair of cord members 42 and 44 are looped about each other to define a pair of oppositely disposed triangular-shaped play sections. Thus, cord 42 and cord 44 are looped at their center points, designated generally at 45. The distal ends of cords 42 and 44 are each provided with eyelets 46 by means of clips 48. The peripheral cord is threaded through eyelets 48 whereby triangular play sections 40 are formed with the apex thereof being centrally located within the peripheral playing area. Accordingly, the formation of the triangular play sections creates a plurality of juxtaposed intermediate-diamond shaped sections 49. It should be noted that other suitable connecting means may be employed in place of the eyelets 46.

Further, included within the hole-down means are a plurality of spike or peg members 50, as illustrated in FIGS. 1 and 5, wherein each hold-down ring 36 receives a peg 50 therethrough, with a locking hook member 52 of peg 50 being hooked over ring 36 when the spike is driven into the ground or sand, generally indicated at 54.

Various playing piece members are included and are shown as marble-shaped members 55. However, the configuration of such pieces can be of any suitable shape as might fit the particular game to be played.

Figure 6:
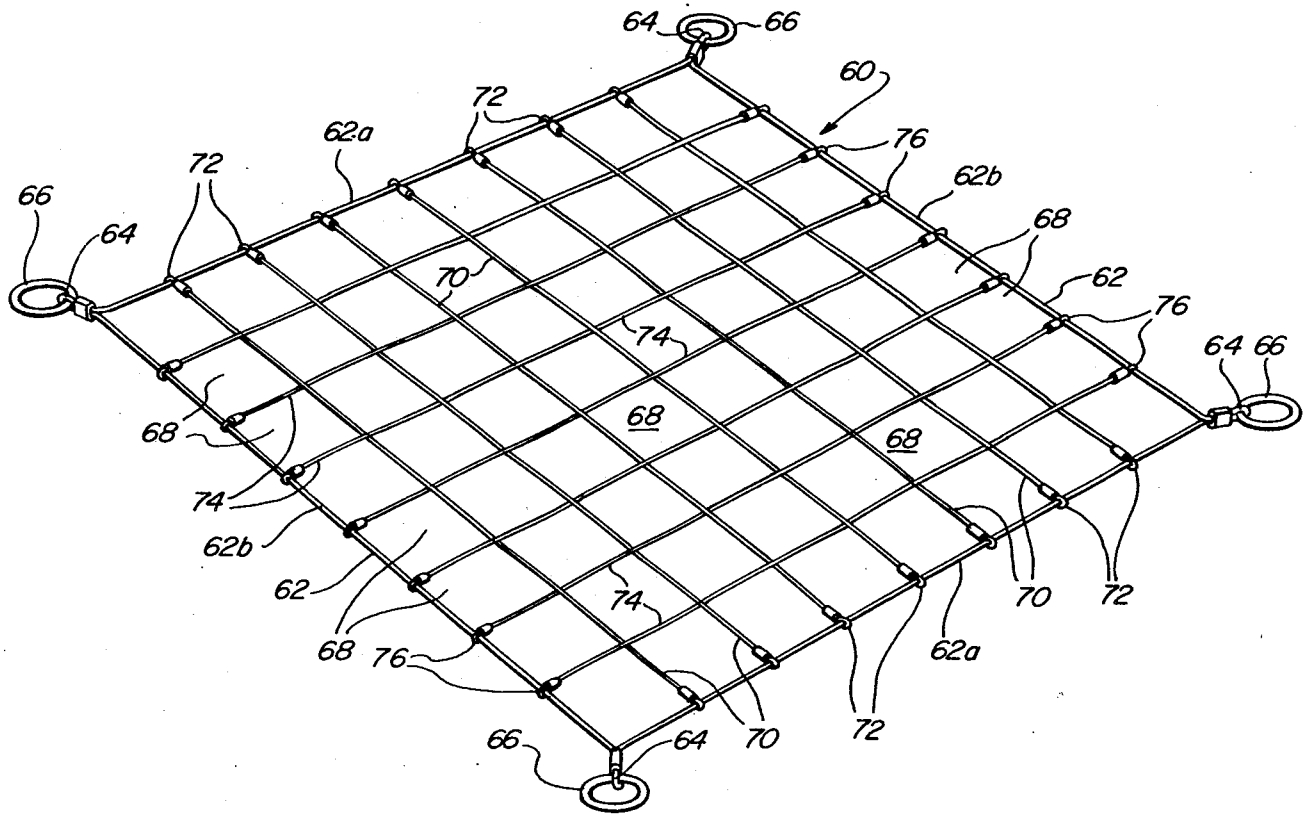
FIG. 6 is a perspective view of an alternative embodiment of the invention which may be used for several different types of well known games that require square play sections.

Referring now to the alternative embodiment as illustrated in FIG. 6, there is shown a board game 60 having a substantially squared configuration wherein the elongated peripheral cord member 62 defines four equal sides of the play area of board game 60. As in the first embodiment of FIG. 1, each corner thereof is provided with an eyelet 64 which supports a hold-down ring 66. To form the necessary play sections 68 there is also provided a plurality of transverse cord members 70 that are attached by eyelets 72 to the oppositely disposed peripheral lateral-side cords 62*a*, the eyelets 72 being affixed to the distal ends of cord members 70. A second set or group of laterally disposed cord members 74 are stretched laterally over and under transverse cords 70 in a woven arrangement and are attached by eyelets 76 to the respective oppositely arranged, peripheral, transverse side cords 62*b*. Accordingly, play sections 68 are defined as contiguous open square areas wherein game pieces are placed therein during the playing of the game. Thus, this particular design of the present invention lends itself to checkers or chess games.

It may be thus seen that the objects of the present invention set forth herein, as well as those made apparent from the foregoing description, are efficiently attained. While preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What I claim is:

1. A game apparatus to be secured in a playing mode on a ground surface comprising:
   - a flexible playing area having a substantially rectangular configuration defined by an elongated peripheral cord member;
   - a plurality of cord section members that are interwoven to form and define a plurality of juxtaposed play sections within said playing area;
   - hold-down means selectively positioned about said peripheral cord member;
   - wherein said cord section members are formed in pairs to define contiguous, triangularly shaped, play sections, whereby each paired cord section member is looped about the other to define a pair of oppositely disposed, triangular shaped play sections; and
   - means for securing said cord section members to said peripheral cord member.

2. A game apparatus as recited in claim 1, wherein said means for securing said cord section members comprises an eyelet formed at each distal end of said cord section members, whereby said peripheral cord member is received therethrough.

3. A game apparatus as recited in claim 2, wherein said hold-down means comprises a plurality of ring members attached to said peripheral cord member.

4. A game apparatus as recited in claim 3, wherein said ring members are connected to at least all four corners of said play area by means of corner eyelets.

5. A game apparatus as recited in claim 4, wherein said hold-down means includes peg members to be received in said ring members whereby said peg members are driven into the ground thereby holding said game apparatus in a play mode.

6. A game apparatus as recited in claim 5, wherein each peg member is formed having a hook member for engagement with said ring member.

7. A game apparatus as recited in claim 6, wherein said game apparatus includes a plurality of game pieces.

* * * * *